US008780145B2

(12) United States Patent
Jyou et al.

(10) Patent No.: US 8,780,145 B2
(45) Date of Patent: Jul. 15, 2014

(54) IMAGE DISPLAY APPARATUS, PICTURE SIGNAL PROCESSING METHOD, AND PROGRAM

(75) Inventors: Shigenobu Jyou, Tokyo (JP); Hiroaki Ikeda, Tokyo (JP); Reiichi Kobayashi, Tokyo (JP)

(73) Assignee: NEC Display Solutions, Ltd., Tokyo (JP)

( * ) Notice: Subject to any disclaimer, the term of this patent is extended or adjusted under 35 U.S.C. 154(b) by 531 days.

(21) Appl. No.: 12/998,769

(22) PCT Filed: Dec. 26, 2008

(86) PCT No.: PCT/JP2008/073699
§ 371 (c)(1),
(2), (4) Date: May 31, 2011

(87) PCT Pub. No.: WO2010/073356
PCT Pub. Date: Jul. 1, 2010

(65) Prior Publication Data

US 2011/0234645 A1 Sep. 29, 2011

(51) Int. Cl.
*G09G 5/10* (2006.01)

(52) U.S. Cl.
USPC ..... 345/690; 345/89; 345/107; 349/56

(58) Field of Classification Search
USPC ..... 345/82–89, 690–693, 107; 349/56, 84
See application file for complete search history.

(56) References Cited

U.S. PATENT DOCUMENTS

| | | | | |
|---|---|---|---|---|
| 5,257,108 | A | 10/1993 | Muraoka | |
| 5,754,150 | A * | 5/1998 | Matsui | 345/89 |
| 7,136,044 | B2 | 11/2006 | Sasaki | |
| 7,671,901 | B2 | 3/2010 | Masuda et al. | |
| 7,742,028 | B2 | 6/2010 | Nitta et al. | |
| 7,809,209 | B2 | 10/2010 | Sakata | |
| 2003/0146919 | A1 * | 8/2003 | Kawashima et al. | 345/609 |
| 2007/0291053 | A1 * | 12/2007 | Kida et al. | 345/690 |

FOREIGN PATENT DOCUMENTS

| | | | |
|---|---|---|---|
| JP | 4-137876 | A | 5/1992 |
| JP | 4-229788 | A | 8/1992 |
| JP | 5-115052 | A | 5/1993 |
| JP | 9-168161 | A | 6/1997 |
| JP | 11-305734 | A | 11/1999 |
| JP | 2002-149121 | A | 5/2002 |
| JP | 2002-333858 | A | 11/2002 |
| JP | 2004-206044 | A | 7/2004 |

(Continued)

*Primary Examiner* — Kimnhung Nguyen
(74) *Attorney, Agent, or Firm* — McGinn IP Law Group, PLLC

(57) ABSTRACT

An image display apparatus includes: a panel (16*a*) that includes a plurality of picture elements that change transmittance of light according to picture levels; a detection unit (12) that detects, in one-image portions of the panel (16*a*), picture levels for each of the plurality of picture elements from picture signals that indicate the picture levels of each picture element; and a processor (18) that, based on the picture levels of one-image portions that were detected by the detection unit (12), adjusts the transmittance of light of the plurality of picture elements such that the image realized by the picture signal is brighter when a value that corresponds to brightness is greater than a predetermined threshold value.

11 Claims, 6 Drawing Sheets

(56) References Cited

FOREIGN PATENT DOCUMENTS

| | | | |
|---|---|---|---|
| JP | 2006-98671 | A | 4/2006 |
| JP | 2006-267140 | A | 10/2006 |
| JP | 2006-349909 | A | 12/2006 |
| JP | 2008-20887 | A | 1/2008 |
| JP | 2008-46613 | A | 2/2008 |
| JP | 2008-299191 | A | 12/2008 |
| WO | WO 03/075257 | A | 9/2003 |

* cited by examiner

IMAGE DISPLAY APPARATUS, PICTURE SIGNAL PROCESSING METHOD, AND PROGRAM

TECHNICAL FIELD

The present invention relates to an image display apparatuses that include projector apparatuses and display apparatuses, a picture signal processing method, and a program for causing a computer to execute the method.

BACKGROUND ART

First, to describe the construction of a liquid crystal panel used in, for example, a projector and display, FIG. 1 shows a sectional view of an example of the configuration of a liquid crystal panel. As shown in FIG. 1, liquid crystal panel 50 includes picture element electrodes 51 that are provided for each picture element and common electrode 52 that is provided opposite picture element electrodes 51, liquid crystal material 53 being injected between these electrodes. Light-shielding units 55 are provided between picture elements to block light and apertures 56 are provided in the portions of picture elements to transmit light. Apertures 56 are portions that can transmit light.

Although transistors for applying the voltage of picture signals are connected to each picture element electrode 51, these components are not shown in the figure.

Liquid crystal panel 50 shown in FIG. 1 is normally a black panel in which the picture element displays black when voltage is not applied across the two electrodes of picture element electrode 51 and common electrode 52. When the difference in potential between common electrode 52 and picture element electrode 51 is a minimum value or in the vicinity of a minimum value, the transmittance of light reaches a minimum value and the picture element displays black. When the difference in potential between common electrode 52 and picture element electrode 51 is a maximum value or in the vicinity of the maximum value, the transmittance of light reached a maximum value and the picture element displays white.

When black is displayed by a picture element, the voltage that is applied across the above-described electrodes is referred to as the "black side voltage," and when white is displayed by a picture element, the voltage that is applied across the above-described electrodes is referred to as the "white side voltage." When liquid crystal panel 50 is on the light path of green among the three primary colors of red, green, and blue, the display screen becomes green when the white side voltage is applied across the above-described electrodes. In the case of red and blue light paths, the display screen becomes red and green, respectively.

The operations of the liquid crystal molecules when a picture element displays white and black are next described. FIG. 2A and FIG. 2B are views for describing the operations of liquid crystal molecules of a liquid crystal material. FIG. 2A shows a case in which voltage is not applied across the two electrodes, and FIG. 2B shows a case in which voltage is applied across the two electrodes.

When voltage is applied to picture element electrode 51 with common electrode 52 as a standard, the liquid crystal molecule 60 of liquid crystal material 53 changes from the state shown in FIG. 2A to the state shown in FIG. 2B, and the orientation of liquid crystal molecule 60 becomes a fixed orientation. The orientation of the liquid crystal molecule is controlled by the field generated by the difference in potential between these electrodes (hereinbelow, this field is referred to as the "vertical field") and light is polarized.

However, when picture elements are caused to display white, an electric field is produced by the difference in the potential of picture signals between adjacent picture elements, as shown in FIG. 1. This electric field is referred to as a "horizontal field." When liquid crystal molecules 60 between picture elements receive the influence of a horizontal field and assume an orientation that differs from the ideal, phenomena such as light leakage are brought about.

The provision of light-shielding units 55 between picture elements prevents light leakage, but the aperture ratio, i.e., the ratio of apertures with respect to the area of one plane of a liquid crystal panel, has been increasing with the higher luminance, higher definition and smaller sizes of liquid crystal panels that are being used in recent years in, for example, liquid crystal projectors. As the aperture ratio increases, the area of light shielding decreases, rendering the configuration more susceptible to the occurrence of light leakage.

In the case of moving pictures in particular, picture element electrodes are charged and discharged by picture signals at a short cycle, and a particular image may cause liquid crystal molecules to orient in an abnormal direction under the influence of the horizontal field, giving rise to abnormalities such as the tailing phenomenon in the display image.

FIGS. 3A and 3B are images for describing an example of the tailing phenomenon of an image. Both figures show the state following movement by a triangle in the direction of the arrows in the figures. FIG. 3A shows the image when normal in which only the triangle after movement is displayed on the screen. FIG. 3B shows the image when an abnormality occurs in which, apart from the triangle after movement, an after-image appears on the screen that extends from the hypotenuse of the triangle in the direction of the triangle before movement.

This tailing phenomenon dissipates when the liquid crystal molecules return to their original direction, but because a time interval on the order of several msec to several tens of seconds elapses before the return to original orientation, the problems arise that, not only is the tailing phenomenon perceptible to the human eye, but in the case of a moving picture, the image also overlaps with the image that is displayed next. However, in a normally black panel such as liquid crystal panel 50, the tailing phenomenon dissipates instantaneously when a black image is introduced.

The above-described phenomenon in which an abnormality of a displayed image is brought about is known to occur when the display of a picture element of liquid crystal panel 50 changes from black to white. The phenomenon does not occur when the display of a picture element changes from white to black. Essentially, it is understood that abnormalities of a display image are related to differences in potential when an image changes and that the tailing phenomenon occurs when voltage is changed from a state of non-application of voltage across electrodes (or a state in which a small voltage is applied) to a state in the vicinity of the maximum voltage. The tailing phenomenon becomes more conspicuous the greater the difference of the voltage change. How to prevent the tailing phenomenon by reducing the difference of voltage change is under examination.

FIGS. 4A and 4B show waveforms of voltage that are applied to picture element electrodes. FIG. 4A shows an example of the normal voltage waveform, and FIG. 4B shows a waveform for a case in which the difference in voltage change is reduced from the waveform shown in FIG. 4A. The vertical axis indicates the voltage and the horizontal axis indicates time.

As shown in FIG. 4A, the applied voltage switches between the plus side and the minus side for each horizontal period. A picture element displays black at or in the vicinity of the minimum value of picture amplitude, and a picture element displays white at or in the vicinity of the maximum value of picture amplitude. Strictly speaking, a picture element displays white when the picture amplitude is 100% and a picture element displays black when the picture amplitude is 0% in the horizontal time intervals.

The time in which a picture element displays white in one horizontal time interval is determined by gradation information that is contained in the picture signal. In the example of the configuration shown in FIG. 1, voltages of plus 5V and minus 5V are alternately applied to picture element electrode 51 when the picture amplitude is 100%, and picture element electrode 51 is set to the same potential as common electrode 52 when the picture amplitude is 0%.

If the vertical axis of the voltage waveform shown in FIGS. 4A and 4B is assumed to be the picture level that corresponds to voltage, the picture level when a picture element displays white is referred to as the white level, and the picture level when a picture element displays black is referred to as the black level. The picture amplitude is a value that is proportional to the picture level.

In the voltage waveform shown in FIG. 4A, the danger of the occurrence of the tailing phenomenon arises because the voltage difference between white display and black display is 5V. In FIG. 4B, the voltage difference between the white level and black level is reduced from the case of the voltage waveform shown in FIG. 4A. More specifically, the absolute value of the voltage applied to picture element electrode 51 during the white level is 5V and thus is the same as for a normal case, but a voltage that is higher than the potential of the common electrode and lower than the white level is applied during the black level. In the example shown in FIG. 4B, the absolute value of the voltage that is applied to picture element electrode 51 during the black level is set to approximately 1V. The voltage value for raising the black level differs depending on the liquid crystal material or the construction of the liquid crystal panel.

An example of a method for reducing the tailing phenomenon is disclosed in JP-A-2008-046613 (hereinbelow referred to as Patent Document 1). According to the technology disclosed in this document, in order to reduce the tailing phenomenon caused by the influence of the horizontal field upon VA (Vertical Alignment) liquid crystal, the picture signal supplied to each picture element is checked and the picture signal is corrected by a correction table each time a predetermined voltage difference is surpassed.

SUMMARY OF THE INVENTION

However, when the method described in FIG. 4B is applied to all images, the problem arises in which the black display is not the true black of the panel itself, but rather, black slightly tinged with white, and the image contrast falls. In particular, portions of the white display fail to stand out when the image is viewed in a dark place.

In addition, the technology disclosed in Patent Document 1 requires the maintenance of a correction table, resulting not only in the problem in which memory is needed to register the correction table, and the consequent increase in circuit size, but the additional problem in which memory is needed to register data in the correction table in advance.

An exemplary object of the invention is to provide an image display apparatus, a picture signal processing method, and a program for causing a computer to execute the method that are capable of suppressing the occurrence of the tailing phenomenon and maintaining contrast.

An image display apparatus according to an exemplary aspect of the invention includes: a panel that includes a plurality of picture elements that change transmittance of light according to picture level; a detection unit that detects, in one-image portions of the panel, picture levels for each of the plurality of picture elements from picture signals that indicate the picture levels of each picture element; and a processor that adjusts the transmittance of light of the plurality of picture elements such that the images produced by the picture signals are brighter when a value corresponding to brightness that is based on the picture levels of a one-image portion that were detected by the detection unit are greater than a predetermined threshold value.

In addition, a picture signal processing method according to an exemplary aspect of the invention is a picture signal processing method for controlling a panel that includes a plurality of picture elements that change transmittance of light according to picture levels, the method including steps of: detecting, in one-image portions of the panel, picture levels for each of the plurality of picture elements from picture signals that indicate the picture level of each picture element; and adjusting the transmittance of light of the plurality of picture elements such that the images produced by the picture signals are brighter when a value that corresponds to brightness based on the picture levels of a one-image portion that were detected is greater than a predetermined threshold value.

Finally, a program according to an exemplary aspect of the invention is a program for causing a computer that controls a panel that includes a plurality of picture elements that change transmittance of light according to picture levels to execute processes of: detecting, in one-image portions of the panel, picture levels for each of the plurality of picture elements from picture signals that indicate the picture levels of each picture element; and adjusting the transmittance of light of the plurality of picture elements such that images produced by picture signals are brighter when a value that corresponds to brightness that is based on the one-image portion of picture levels that were detected is greater than a predetermined threshold value.

EXPLANATION OF REFERENCE NUMBERS

Figure 1:
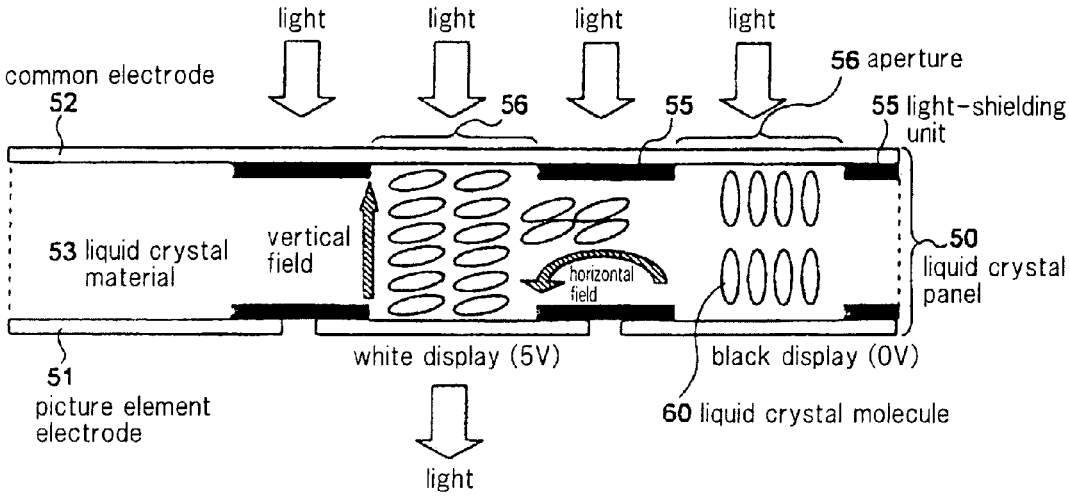
FIG. 1 is a sectional view showing an example of the configuration of a liquid crystal panel.
Figure 2A:
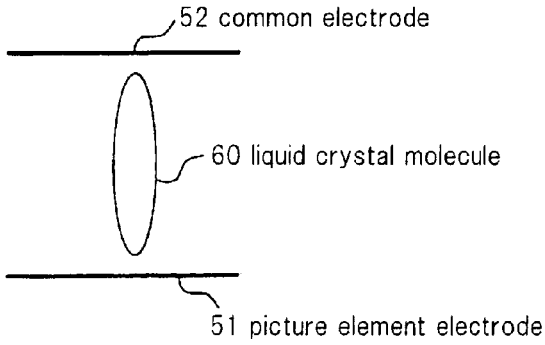
FIG. 2A is a view for describing the movement of a liquid crystal molecule.
Figure 2B:
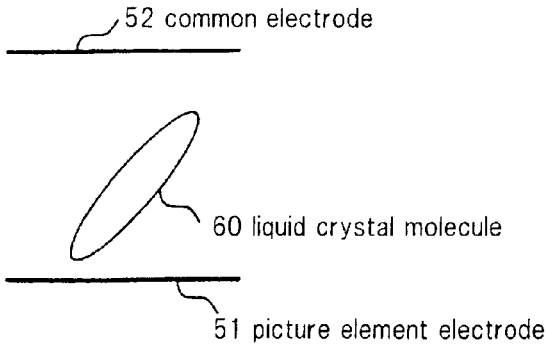
FIG. 2B is a view for describing the movement of a liquid crystal molecule.
Figure 3A:
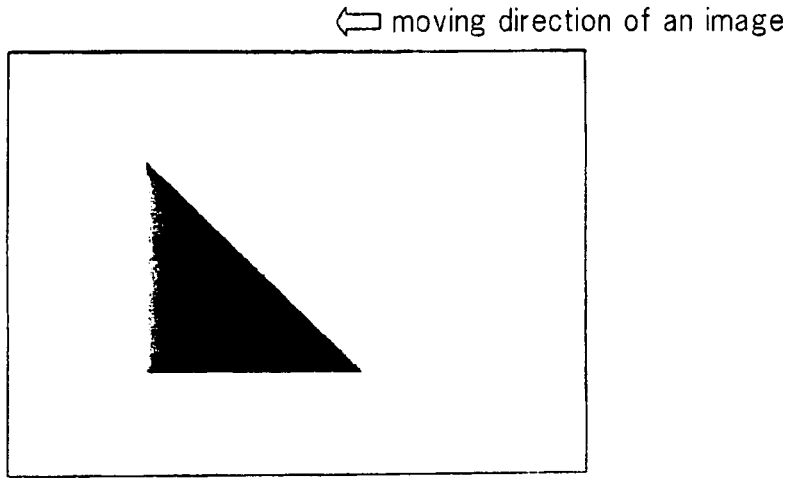
FIG. 3A is a view for describing the tailing phenomenon of an image.
Figure 3B:
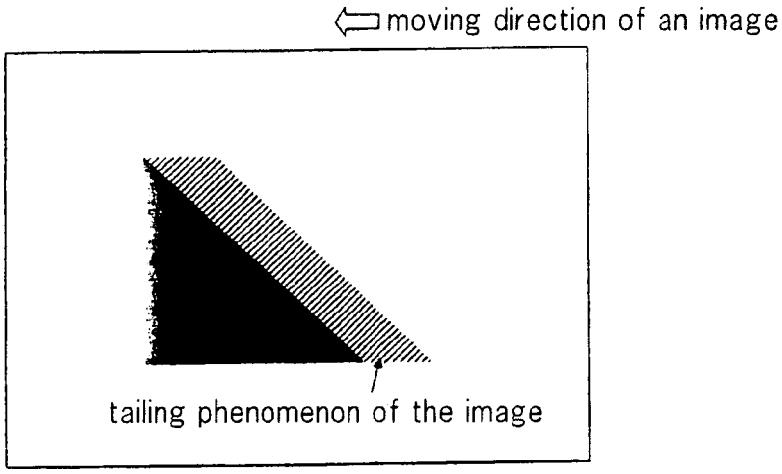
FIG. 3B is a view for describing the tailing phenomenon of an image.
Figure 4A:
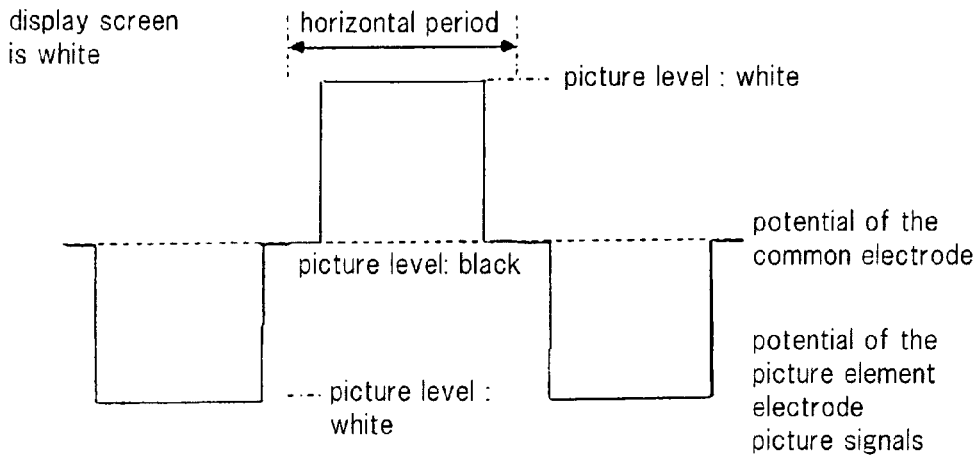
FIG. 4A shows an example of the waveform of voltage that is applied to a picture element electrode.
Figure 4B:
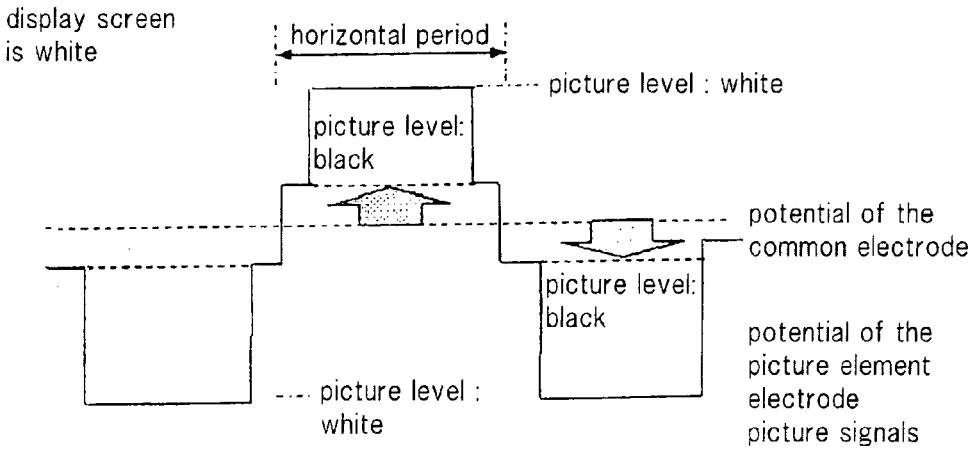
FIG. 4B is a waveform when the difference of voltage change is made smaller than that of the waveform shown in FIG. 4A.

11 picture signal processing circuit
12 APL/histogram detection unit
14 ac drive unit
15 liquid crystal drive circuit
16*a*-16*c* liquid crystal panel
18 CPU
100 projector
114 image processing unit

BEST MODE FOR CARRYING OUT THE INVENTION

The present exemplary embodiment is next described. In the present exemplary embodiment, the image display apparatus is assumed to be a projector.

Figure 5:
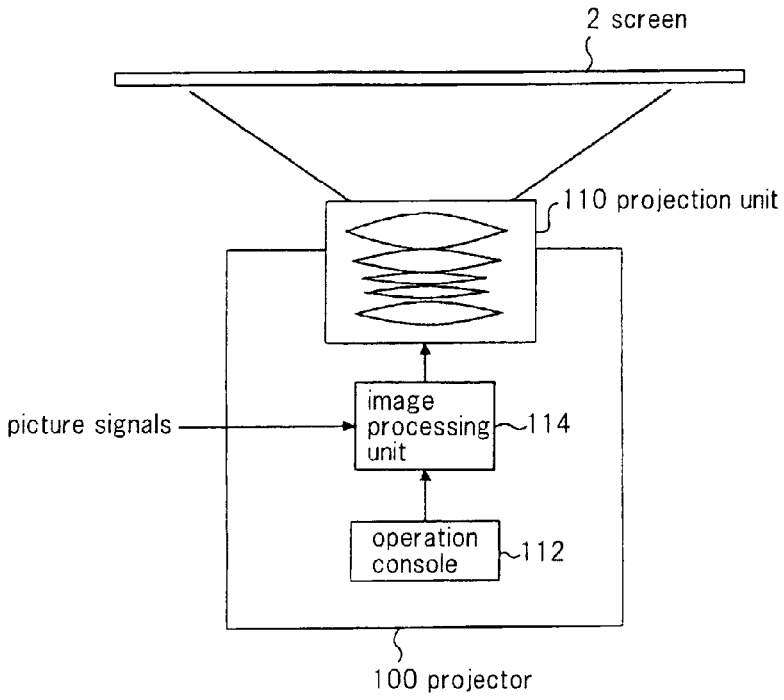
FIG. 5 is a block diagram showing an example of the configuration of a projector of the present exemplary embodiment.

FIG. 5 is a block diagram showing an example of the configuration of the projector of the present exemplary embodiment. As shown in FIG. 5, projector 100 includes projection unit 110, image processing unit 114, and operation console 112. As equipment that applies picture signals as input to image processing unit 114, examples that can be offered include information processing apparatuses such as a personal computer, a television, and a DVD player. The picture signals are, for example, RGB-component picture signals.

Projection unit 110 includes a light source (not shown) and a plurality of lenses for projecting an image formed by a light bulb onto screen 2, and a focus adjustment unit (not shown) that moves the lenses along the optical axis.

Operation console 112 is provided with a plurality of control buttons and switches for causing projector 100 to operate. A remote controller is also included for transmitting the user's instructions to the main unit by infrared communication.

Figure 6:
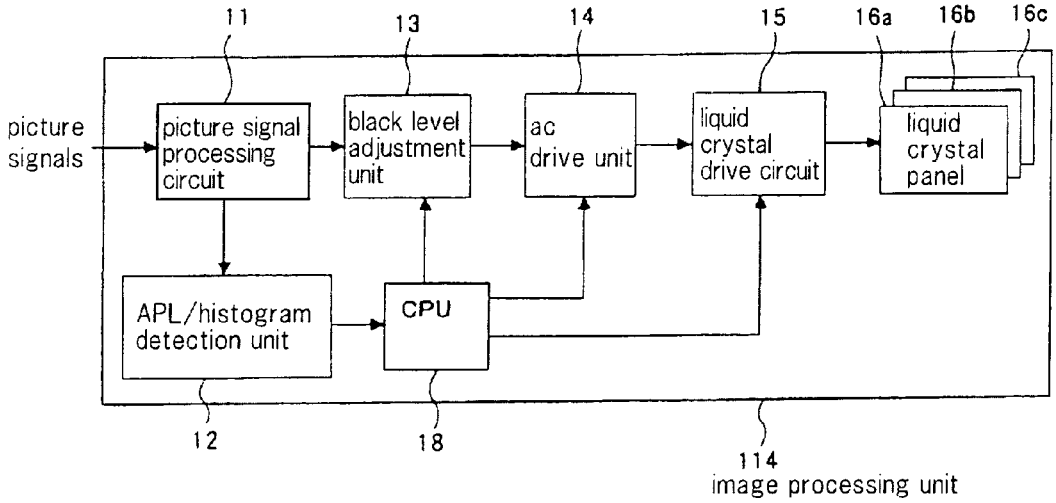
FIG. 6 is a block diagram showing an example of the configuration of the image processing unit shown in FIG. 5.

Details of image processing unit 114 shown in FIG. 5 are next described. FIG. 6 is a block diagram showing an example of the configuration of the image processing unit of the present exemplary embodiment.

As shown in FIG. 6, image processing unit 114 of the present exemplary embodiment includes: picture signal processing circuit 11, APL (Average Picture Level)/histogram detection unit 12, black level adjustment unit 13, ac drive unit 14, liquid crystal drive circuit 15, CPU (Central Processing Unit) 18 that executes predetermined processing in accordance with a program, and liquid crystal panels 16*a*-16*c* that correspond to RGB.

Picture signal processing circuit 11 carries out signal discrimination such as the horizontal frequency, vertical frequency, and resolution for picture signals that are received as input and carries out various image processing operations such as picture quality processing and conversion to resolution that can be displayed on liquid crystal panels 16*a*-16*c*.

APL/histogram detection unit 12 detects picture levels based on the picture signals that follow image processing in picture signal processing circuit 11. Then, based on information of the picture levels of a one-image portion, APL/histogram detection unit 12 carries out: calculation of Average Picture Levels (APL), calculation of the incidence of picture levels, or creation of a histogram of the picture levels for each of red, green, and blue.

Although it is preferable to carry out the APL detection by signals that follow the implementation of image processing by picture signal processing circuit 11, APL detection may also be carried out with picture signals that precede image processing. Although a case is described in the present exemplary embodiment in which APL/histogram detection unit 12 detects APL, a case in which APL/histogram detection unit 12 calculates incidence and a case in which APL/histogram detection unit 12 creates a histogram are described in the working examples. Because the brightness of a screen increases in proportion to the magnitude of the APL, the APL is equivalent to a value that corresponds to brightness in the present invention.

CPU 18 receives the APL of a one-image portion for each of red, green, and blue, and for each color, when the value of an APL surpasses a predetermined threshold value for an APL of a one-image portion, CPU 18 reports an offset amount to black level adjustment unit 13 to shift the black level toward the white display side by a predetermined offset amount. The black level in the present exemplary embodiment includes the meaning of not only the picture level for causing an absolutely black display, but also the black level that follows shifting from the black display toward the white display side by a predetermined offset amount. The threshold value information is stored in advance in memory (not shown) in CPU 18, but may be rewritten by the execution of a program by CPU 18.

However, setting the black level to different values for each of the colors of red, green, and blue causes red, green, and blue color shifts. CPU 18 therefore compares the APL of each color to find the APL value that is the maximum, determines the offset amount of the black level by the APL value that was found, and reports the black level offset amount of each color to black level adjustment unit 13.

An actual example of the determination of the offset amount is next described. Assuming that the APL of a display image at a particular time point are 10% for red, 50% for green, and 90% for blue, the black level of the liquid crystal panel of each color is set for the case in which the APL is 90%.

In the case of a black and white screen, determination of the APL maximum value of the above-described three primary colors is unnecessary. In addition, because on-screen display such as a menu screen is not a moving picture display and image abnormalities can be ignored, the timing of shifting the black level does not present a problem. As described hereinabove, determining the offset amount of the black level for the three primary colors by the APL maximum value prevents color shifts, but when a reduction of contrast is conspicuous for the color for which the APL is the minimum value (red in the above-described actual example), the average value may be used in place of the maximum value of the APLs of the three primary colors.

Black level adjustment unit 13 carries out adjustment for shifting picture levels by the offset amount during black display in accordance with information of offset amounts that are received from CPU 18 and supplies as output level signals that indicate the picture levels following adjustment. Shifting the black display picture levels toward the white display side condenses the picture levels between black display and white display. For example, when the voltage that corresponds to black level is shifted from the voltage of the common electrode (0V) to 1V, picture levels for the range that extends from 0V up to 5V are reflected in the range from 1V to 5V. As a result, the entire image becomes brighter.

AC drive unit 14 converts the voltage that corresponds to the level signals instructed from black level adjustment unit 13 to an alternating current and supplies the result. Liquid crystal drive circuit 15 drives liquid crystal panels 16*a*-16*c* in accordance with the ac voltage that is supplied from ac drive unit 14.

Although APL/histogram detection unit 12, CPU 18, and black level adjustment unit 13 are provided apart from picture signal processing circuit 11 in the present exemplary embodiment, APL/histogram detection unit 12, CPU 18, and black level adjustment unit 13 may also be provided in picture signal processing circuit 11 or may be provided in liquid crystal drive circuit 15. Although a case was described in which the picture signals that are received as input from the outside are RGB, the signals may also be YUV, which is a mode of conveying information of luminance and color difference. In such a case, a conversion circuit (not shown) for converting the YUV picture signals to RGB picture signals is provided in picture signal processing circuit 11.

Figure 7:
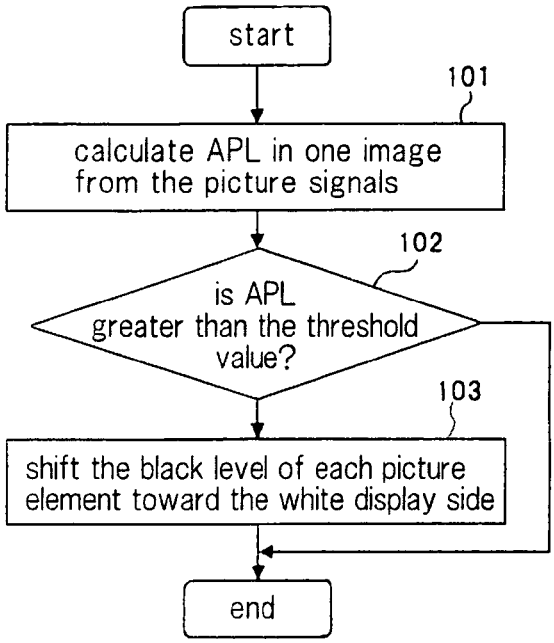
FIG. 7 is a flow chart showing the progression of operations of the picture signal processing method of the present exemplary embodiment.

The operations of image processing unit 114 of the present exemplary embodiment are next described. FIG. 7 is a flow chart showing the flow of operations of the picture signal processing method of the present exemplary embodiment. Explanation here focuses on any one of the three primary colors red, green, and blue.

Upon input of a picture signal, picture signal processing circuit 11 carries out signal discrimination of the picture signal and converts it to a resolution to be displayed on liquid crystal panels 16*a*-16*c*. Various types of image processing such as image quality processing are further carried out. APL/histogram detection unit 12 then calculates APL in one image for the picture signal that follows the implementation of various image processes (Step 101) and passes the value to CPU 18. Upon receiving the APL from APL/histogram detection unit 12, CPU 18 judges whether the APL is greater than a predetermined threshold value or not (Step 102). If an APL is greater than the threshold value, CPU 18 shifts the black level of each picture element toward the white display side (Step 103) and reports the offset amount to black level adjustment unit 13.

In the case of three primary colors, it is determined in Step 102 whether any one of the values of the APL of each color is greater than the threshold value. If even one value surpasses the threshold value, the APL is compared to find the maximum value or the average value of the values is calculated. The offset amount of the black level that corresponds to the obtained value is found and the offset amount is applied to the black level of each color.

Black level adjustment unit 13 next carries out adjustment for shifting the actual picture level of the black display by the offset amount according to the offset amount information that was received from CPU 18 and supplies level signals indicating the picture levels following adjustment for each color. AC drive unit 14 converts the voltage that corresponds to the level signals that were instructed from black level adjustment unit 13 to alternating current and supplies the result as output. Liquid crystal panels 16*a*-16*c* are next driven by liquid crystal drive circuit 15 and images are displayed. The black display picture level of images that are displayed has been shifted by a predetermined amount toward the white display side, whereby the transmittance of each picture element increases in accordance with the picture level and the entire image becomes brighter.

Figure 8:
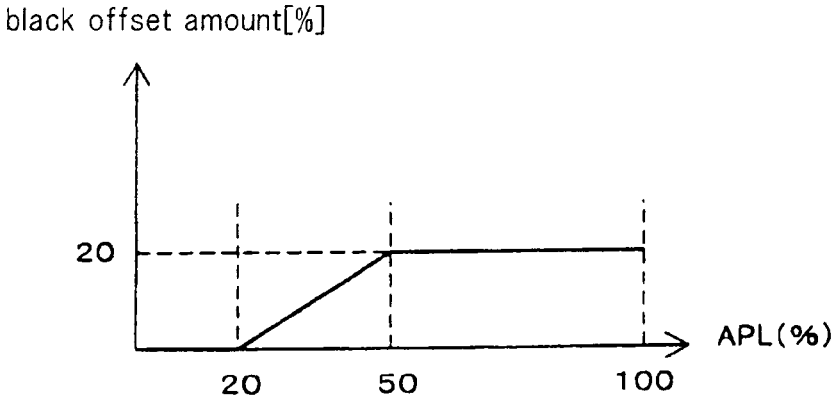
FIG. 8 is a view for describing an example of the method of adjusting the black level.

FIG. 8 is a view for describing an example of the method of adjusting black level. The horizontal axis of FIG. 8 is the APL (%) and the vertical axis is the offset amount (%) by which the black level is shifted toward the white display side. The vertical axis of FIG. 8 is assumed to be 100% when white is displayed in a picture element. Images become brighter as APL increases and become darker as APL decreases.

In the graph shown in FIG. 8, the black offset amount is increased linearly from 0% to 20% with increase of APL in the range of APL from 20% to 50%. Then, over the range of APL=50 to 100%, the offset amount is made 20%. For example, assuming that the picture amplitude of white display is 5V, when APL=50 to 100%, the black level is set to a voltage that is 1V higher by absolute value than the potential of the common electrode, and the magnitude of the picture level is reflected by a picture amplitude having a range from 1V to 5V.

The black offset amount is here not set greater than 20% because when there are black portions on the same screen, the sense of contrast with these portions tends to be lost.

The graph shown in FIG. 8 is an example, and a graph of the relation between the APL and offset amount changes for each type of panel. This variation arises because the degree of screen abnormality resulting from horizontal field varies according to the size, resolution and aperture ratio of a liquid crystal panel.

Although immediate application is desirable when black levels are increased, the operation should be carried out over an average of from several screens to several tens of screens when black levels are to be returned to their original levels. This operation has the effect of smoothing changes in luminance of a screen and thus preventing sudden changes in brightness of a screen when the APL suddenly changes.

In the present exemplary embodiment, when the value that corresponds to the brightness of an image is greater than a predetermined threshold value, the black level is shifted by a predetermined amount toward the white display and the transmittance of each picture element is adjusted such that the entire image is brighter. In this way, not only is the occurrence of the tailing phenomenon of a black image suppressed, but contrast can also be ensured.

Working Example 1

The present working example is a case in which the incidence of picture levels is detected in one image, and when the incidence of the white level is greater than a predetermined threshold value, the black level is shifted by a predetermined amount.

APL/histogram detection unit 12 calculates the incidence of the picture levels of red, green, and blue for each image based on picture signals. In the present working example, not only a white display but also a display close to white is set to the white level, and picture levels that are at least a first prescribed value are taken as the white level. For a black display as well, a black display and a display close to black are taken as the black level, and picture levels that are equal to or lower than a second prescribed value are taken as the black level.

In the present working example, a picture signal processing method realized by CPU 18 is described.

Figure 9:
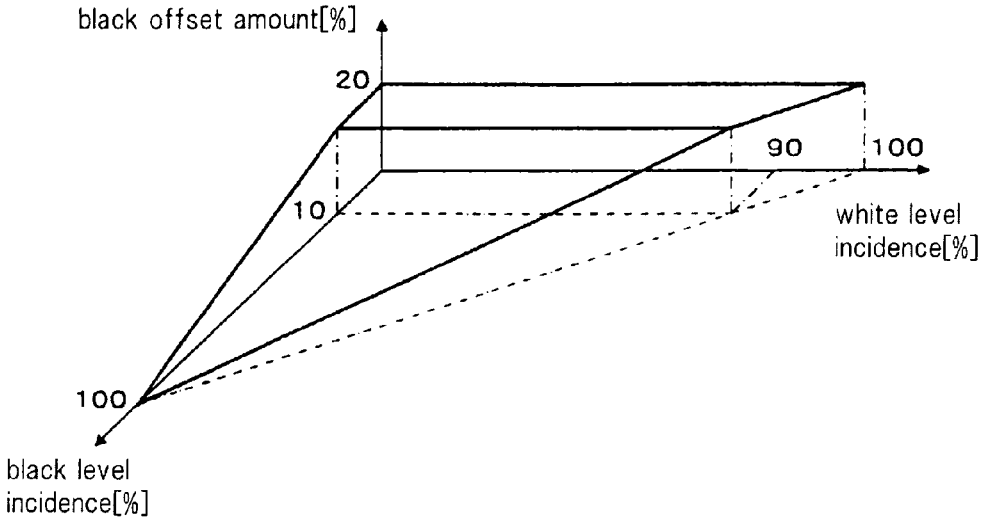
FIG. 9 is a view for describing an example of the method of adjusting the black level in Working Example 1.

FIG. 9 is a view for describing an example of the black level adjustment method of the present working example. FIG. 9 is a three-dimensional graph with the two horizontal axes within one plane in the graph being orthogonal. The first horizontal axis is the white level incidence (%) of one image, and the second horizontal axis is the black level incidence (%) of the same image. The vertical axis that is orthogonal to both horizontal axes is the black offset amount (%).

The vertical axis of FIG. 9 is assumed to be 100% when white is displayed in a picture element and 0% when black is displayed. The first prescribed value is assumed to be 80% and the second prescribed value is assumed to be 20%.

As shown in FIG. 9, the tailing phenomenon does not occur when the incidence of the black level is 100%, and the black offset amount is therefore 0%. As the incidence of the black level gradually decreases from 100%, the black offset amount is linearly increased, and when the incidence of the black level is 10%, the black offset amount is set to 20%. If this is described in terms of the incidence of the white level, the black offset amount is linearly increased as the incidence of the white level gradually increases from 0%, and the black offset amount becomes 20% when the incidence of the white level reaches 90%. The black offset amount is then set to 20% within the range in which the black level incidence is from 10% to 0%, or in other words, within the range in which the white level incidence is from 90% to 100%. If images in which the black level is not detected are continuous, the black offset is slowly returned to 0% over several seconds.

If the screen that is the object of control is a black and white screen, referring to the line that connects the point at which the black level incidence is 100% and the point at which the white level incidence is 100% in FIG. 9, the black offset amount is determined if the white level or black level is determined.

To prevent color shift among red, green and blue, the black offset amount must be set such that the same proportion of levels is obtained with respect to the maximum level. For example, if the incidence of the black level of a display image at a particular time is 0% for red, 5% for green, and 10% for blue, then control of the picture levels is preferably implemented at the value when the black level incidence is 10% for red, green, and blue. This is equivalent to matching to the black offset amount of, among the colors, the color for which the white level incidence is the minimum value.

By setting a display that is close to white to the white level and setting a display that is close to black to the black level as in the present working example, a display that is close to white may be made the white display and a display that is close to black may be made the black display. The incidence of white display is equivalent to the value that corresponds to brightness in the present invention.

Working Example 2

The present working example is a case in which a histogram of the picture levels in one image is created, and when the distribution rate from the center values of the histogram to the white display side is greater than the distribution rate from the center values to the black display side, the black level is shifted by a predetermined amount. In the present working example, the picture levels are luminance gradations. In addition, the distribution rate from the center value to the white display side of a histogram is equivalent to that value that corresponds to brightness in the present invention.

APL/histogram detection unit 12 creates a histogram for each of the picture levels of red, green, and blue for each image based on picture signals and passes the histogram to CPU 18.

The picture signal processing method that is realized by CPU 18 in the present working example is next described. Explanation here regards one color, and because the method of determining the black level offset amount for the three colors red, green, and blue is the same as the method described in the exemplary embodiment, detailed explanation is here omitted.

Figure 10:
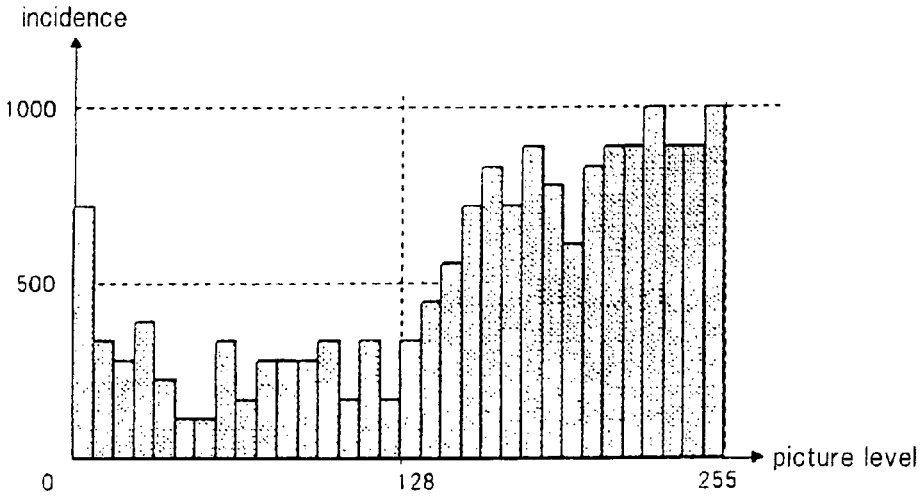
FIG. 10 is a view for describing an example of the method of adjusting the black level in Working Example 2.

FIG. 10 is a view for describing an example of the black level adjustment method of the present working example. FIG. 10 is a histogram in which the picture levels between black display and white display are divided into 256 gradations, groups of eight gradations each being shown on the horizontal axis and the incidence being shown on the vertical axis. In this figure, the black display is equivalent to a picture level of 0 and the white display is equivalent to a picture level of 255.

When the distribution rate of picture levels of 128 gradations or more is greater than 50% in the histogram shown in FIG. 10. CPU 18 sets an offset amount to the black level. When neither the white display nor the black display is present, the problem of the tailing phenomenon does not occur, and an offset amount should therefore be set to the black level only when the incidences of the white display and black display are both detected and when the white display is more frequent.

When setting an offset amount to the black level, switching is instantaneous because the screen around the black level is bright, but when offsetting of the black level is cancelled and the black level is returned to the original black level, the return is preferably slowed over several seconds to make the switch between offset and no offset imperceptible.

Working Example 3

The present working example is a case in which both the APL and a histogram of picture levels in one image are detected and this APL and histogram are then used to control the offset of the black level.

APL/histogram detection unit 12 calculates APL for each of the picture levels of red, green and blue for each image based on picture signals and creates a histogram. APL/histogram detection unit 12 further determines whether the white display picture level is present for each image.

The picture signal processing method realized by CPU 18 in the present working example is next described. The APL threshold value is here assumed to be 50%. In addition, explanation here regards the case of one color, and because the method of determining the offset amount of the black level for the three colors of red, green, and blue is the same as the method described in the exemplary embodiment, detailed explanation is here omitted.

CPU 18 refers to the APL and histogram received from APL/histogram detection unit 12, and if an APL is greater than the threshold value, and moreover, if even one instance of a white display picture level is detected by APL/histogram detection unit 12, CPU 18 sets the black level offset amount to 10%. When there is no white display picture level in one image, the problem of the tailing phenomenon does not occur, and offsetting of the black level is therefore not effected even should an APL surpass the threshold value.

The timing of switching when setting and when cancelling the black level offset amount is the same as in the method described in Working Example 2, and detailed explanation is therefore here omitted. In addition, although the black level offset amount was assumed to be 10% in the present working example, the offset amount is not limited to 10%. Although the black level is shifted in the event of even one instance of the white display picture level, the threshold value may also be set to a number of instances of the white display picture level that is greater than one.

Working Example 4

The present working example is a case in which control is implemented to shift the black level when a plurality of images that continue are detected to be moving pictures in any of the methods described in the exemplary embodiment and Working Examples 1 to 3 described hereinabove.

APL/histogram detection unit 12 investigates whether there are changes in the picture levels of a plurality of continuous images. As the method of investigating changes of picture level, changes of picture levels of each picture element in one image may be investigated, but investigating whether or not changes have occurred for all picture elements increases the load of the detection process.

In the case of moving pictures, the probability that the APL, the incidence of white display, and histograms of picture levels will match, among all of a continuous plurality of images, is considered to be low. APL/histogram detection unit 12 may determine a plurality of continuous images to be moving pictures if changes occur among any of the APL, incidence of white display, and histograms of picture levels among the plurality of continuous pictures. Upon detecting a change of the picture levels among images, APL/histogram detection unit 12 determines that moving pictures have been detected and transmits to CPU 18 a moving picture detection signal to report the detection of moving pictures.

Only upon receiving a moving picture detection signal from APL/histogram detection unit 12, does CPU 18 shift the picture levels of the black display of picture elements of the liquid crystal panel toward the white display side based on any of the methods of the exemplary embodiment and Working Example 1 to 3 described hereinabove.

The timing of switching when setting and when cancelling the offset amount of the black level in the present working example is again the same as the method described in Working Example 2, and detailed explanation is therefore here omitted.

The image display apparatus of the present working example includes display devices used in information processing devices such as personal computers or workstations, and the picture signal processing method of the present exemplary embodiment therefore may also be executed by a computer. In such cases, the display device is a liquid crystal display. In addition, the operations of APL/histogram detection unit 12 may be described in advance in a program, and the program may then be executed on CPU 18.

Regarding the above-described exemplary embodiment and any of Working Examples 2 to 4, a margin may also be provided to the picture levels for each of the white display and black display as in Working Example 1.

While the invention has been particularly shown and described with reference to exemplary embodiments and examples thereof, the invention is not limited to these embodiments and examples. It will be understood by those of ordinary skill in the art that various changes in form and details may be made therein without departing from the spirit and scope of the present invention as defined by the claims.

The invention claimed is:

1. An image display apparatus comprising:

a panel that includes a plurality of picture elements that change transmittance of light according to picture level;

a detection unit that detects, in one-image portions of said panel, picture levels for each of said plurality of picture elements from picture signals that indicate said picture level of each picture element; and a processor that adjusts the transmittance of light of said plurality of picture elements such that the image produced by said picture signals is brighter when a value corresponding to brightness that is based on the picture levels of one-image portions that were detected by said detection unit is greater than a predetermined threshold value, wherein said detection unit calculates an average picture level as said value that corresponds to brightness from said picture levels of one-image portions, and wherein said processor, when said average picture level is greater than said predetermined threshold value, increases said transmittance of light of said plurality of picture elements in proportion to the average picture level.

2. The image display apparatus according to claim 1, wherein said detection unit determines whether a picture level of a white display in which said transmittance of light is a maximum is present in said picture levels of one-image portions, and wherein said processor, when said average picture level is greater than said predetermined threshold value, and moreover, when said detection unit determines that said picture level of said white display is present, increases said transmittance of light by a predetermined amount.

3. The image display apparatus according to claim 1, wherein said detection unit investigates whether a change occurs in picture levels of a plurality of continuous images, and if a change is detected, transmits to said processor a moving picture detection signal to report that moving pictures have been detected, and wherein said processor, only when the moving picture detection signal has been received from said detection unit, adjusts said transmittance of light of said plurality of picture elements.

4. The image display apparatus according to claim 1, wherein three said panels each having said plurality of picture elements are provided corresponding to each of three primary colors of red, green, and blue, wherein said picture signals include information of said picture levels for each of said three primary colors corresponding to said plurality of picture elements, and wherein said processor, when one or more of said values that correspond to a brightness of each of said three primary colors is greater than said predetermined threshold value, adjusts said transmittance of light of said plurality of picture elements of said panels that correspond to each of said three primary colors.

5. The image display apparatus according to claim 4, wherein said processor adjusts said transmittance of light of said plurality of picture elements with a maximum value or an average value of said values that correspond to the brightness of each of said three primary colors as a standard.

6. The image display apparatus according to claim 1, wherein said panel comprises a liquid crystal display having said plurality of picture elements for each of three primary colors of red, green, and blue;

wherein said picture signals include information of said picture levels for each of said three primary colors corresponding to said plurality of picture elements; and wherein said processor, when even one of said values that correspond to the brightness of each of said three primary colors is greater than said predetermined threshold value, adjusts said transmittance of light of said plurality of picture elements that correspond to each of said three primary colors.

7. The image display apparatus according to claim 6, wherein said processor adjusts said transmittance of light of said plurality of picture elements with a maximum value or an average value of said values that correspond to the brightness of each of said three primary colors as a standard.

8. A picture signal processing method for controlling a panel that includes a plurality of picture elements that change transmittance of light according to picture levels, said picture signal processing method comprising:

detecting, in one-image portions of said panel, picture levels for each of said plurality of picture elements from picture signals that indicate said picture levels of each picture element;

adjusting said transmittance of light of said plurality of picture elements such that images produced by said picture signals are brighter when a value that corresponds to brightness that is based on the picture levels of one-image portions that were detected is greater than a predetermined threshold value;

calculating an average picture level as said value that corresponds to brightness from said picture levels of one-image portions; and increasing said transmittance of light of said plurality of picture elements in proportion to the average picture level when said average picture level is greater than said predetermined threshold value.

9. The picture signal processing method according to claim 8, further comprising:

determining whether a white display picture level in which said transmittance of light is a maximum is present in said picture levels of one-image portions; and increasing by a predetermined amount said transmittance of light of said plurality of picture elements when said average picture level is greater than said predetermined threshold value, and moreover, when said white display picture level is included in said one-image portions of picture levels.

10. A non-transitory computer-readable storage medium storing a program for causing a computer that controls a panel that includes a plurality of picture elements that change transmittance of light according to picture levels to execute processes of:

detecting, in one-image portions, picture levels for each of said plurality of picture elements from picture signals that indicate said picture levels of each picture element;

adjusting said transmittance of light of said plurality of picture elements such that images produced by said picture signals are brighter when a value that corresponds to brightness that is based on said one-image portions of picture levels that were detected is greater than a predetermined threshold value;

calculating an average picture level as said value that corresponds to brightness from said picture levels of one-image portions; and when said average picture level is greater than said predetermined threshold value, increasing said transmittance of light of said plurality of picture elements in proportion to the average picture level.

11. The non-transitory computer-readable storage medium according to claim 10, said program further causing said computer to execute processes of:

determining whether a white display picture level in which said transmittance of light is a maximum is present in said one-image portions of picture levels; and when said average picture level is greater than said predetermined threshold value, and moreover, when said white display picture level is contained in said one-image portions of picture levels, increasing, by a predetermined amount, said transmittance of light of said plurality of picture elements.

* * * * *